US006321804B1

(12) United States Patent
Mangold

(10) Patent No.: US 6,321,804 B1
(45) Date of Patent: Nov. 27, 2001

(54) PROCESS FOR GRINDING AND COLORING WOOD CHIPS

(75) Inventor: Christopher Mangold, Hilton, NY (US)

(73) Assignee: Mangold Recycling Inc., Rochester, NY (US)

( * ) Notice: Subject to any disclaimer, the term of this patent is extended or adjusted under 35 U.S.C. 154(b) by 0 days.

(21) Appl. No.: 09/547,826

(22) Filed: Apr. 8, 2000

(51) Int. Cl.[7] ..... B27M 1/00; B02C 17/00

(52) U.S. Cl. ..... 144/364; 144/380; 144/162.1; 241/15; 241/24.2; 241/195; 241/236

(58) Field of Search ..... 144/162.1, 172, 144/174, 364, 380; 241/15, 24.1, 24.2, 28, 46.08, 78, 101.72, 101.74, 101.75, 101.76, 195, 236, 248

(56) References Cited

U.S. PATENT DOCUMENTS 4,681,146 * 7/1987 Liska et al. ..... 144/380 X
5,133,507 * 7/1992 Sepling et al. ..... 241/28
5,326,614 * 7/1994 Doose ..... 241/28 X

* cited by examiner

*Primary Examiner*—W. Donald Bray
(74) *Attorney, Agent, or Firm*—Greenwald & Basch LLP; Howard J. Greenwald

(57) ABSTRACT

A process for producing a colored wood product, comprising the steps of grinding wood in a mill until a wood compact is formed, sieving the wood compact, spraying the sieved wood compact with an aqueous solution of colorant, immersing the wood compact in a bath of aqueous solution of colorant while simultaneously moving the wood compact with a multiplicity of counterrotating augers, and then removing the wood compact from said bath.

19 Claims, 4 Drawing Sheets

PROCESS FOR GRINDING AND COLORING WOOD CHIPS

FIELD OF THE INVENTION

A process for grinding and coloring wood chips.

BACKGROUND OF THE INVENTION

U.S. Pat. No. 5,308,653 of Rondy discloses a process for preparing a colored wood product, such as mulch. In the first step of the process of this patent, comminuted wood is fed into a screw conveyor having a first end and a second end, wherein the screw conveyor has a helical auger disposed axially and in close fitting relationship to the internal surface within a generally closed channel, and with a feed port near the first end and a discharge end near the second end, the helical augur being capable of being rotated by a drive means; in this step, the conmminuted wood is fed through the feed port into the first end of the conveyor. In the second step of the process of this patent, the conmminuted wood is contacted with an aqueous color-imparting solution containing at least one color-imparting agent therein for sufficient time to disperse the color-imparting solution onto the surfaces of the comminuted wood to create a colored wood product, such contact occurring at least at the feed port through a feed port nozzle means substantially transversing the feed port and providing a gravity feed sheet of the color imparting solution from a longitudinal slot formed therein. In the third step of the process of this patent, the augur is rotated so that the colored wood product is drawn from the first end to the second end, during which time excess color-imparting solution is drained away from the colored wood product, thereby drying the colored wood product. In the last step of the process, the dried colored wood product is discharged from the screw conveyor (via a discharge chute) and further dried, if necessary. The entire disclosure of thing United States patent is hereby incorporated by reference into this specification.

The process of the Rondy patent produces a colored mulch patent with a substantially non-uniform particle size distribution and non-uniformly colored particles. Furthermore, the colored mulch produced by the Rondy patent is not intensely colored.

It is an object of this invention to provide a process for producing a colored mulch which has intense color and which is substantially more uniform than the prior art colored mulch products.

SUMMARY OF THE INVENTION

In accordance with this invention, there is provided a process for producing a colored mulch in which wood is ground by a mill until a compact is formed with at least 80 weight percent of the particles smaller than 4.0 inches, the compact thus formed is sieved to produce a sieved product, the sieved product is then sprayed with a colorant solution while it is being conveyed by a multiplicity of augers to produce a first colored sieved product, the first colored sieved product is immersed in a bath of colorant solution to produce a second colored sieved product, and the second colored sieved product is removed from the bath by a multiplicity of augers and dried.

BRIEF DESCRIPTION OF THE DRAWINGS

The invention will be described by reference to the specification and the enclosed drawings, in which like numerals refer to like elements, and in which.

DESCRIPTION OF THE PREFERRED EMBODIMENTS

Figure 1:
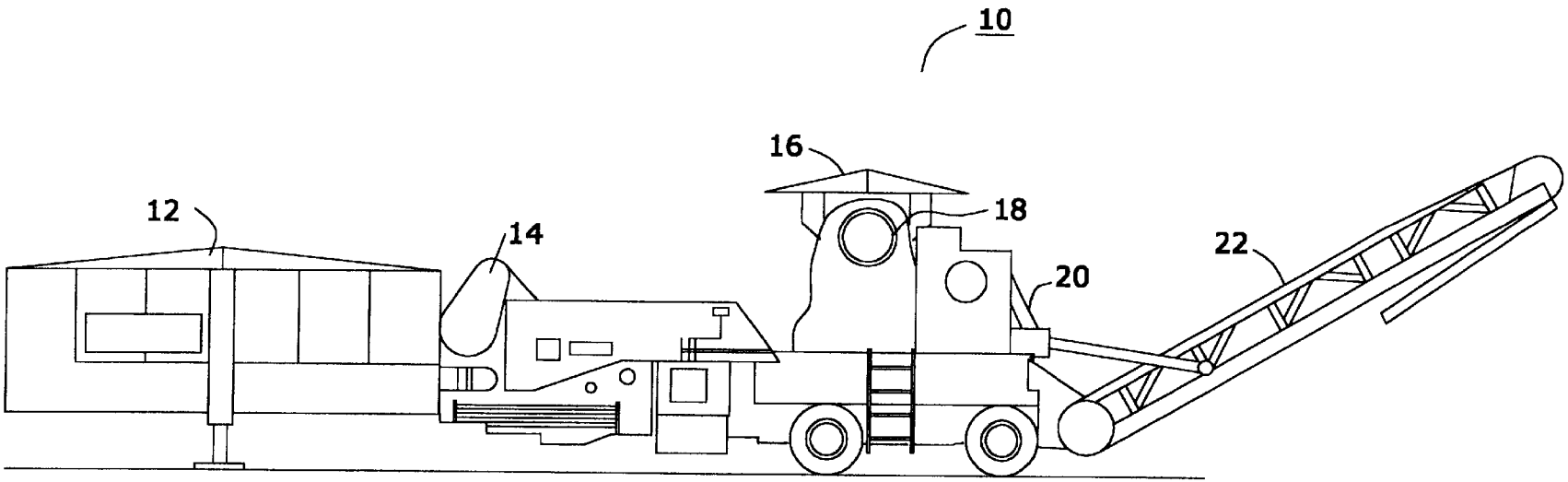
FIG. 1 is a side view of one preferred apparatus suitable for practicing the process of the invention.

FIG. 1 is a side view of one preferred color grinder 10 apparatus adapted to practice the process of this invention. One preferred color grinder 10 was produced in accordance with applicant's specifications and is sold as model number 3600 by Morbark, Inc. of 8507 South Winn Road, Winn, Mich.

Referring to FIG. 1, and in the preferred embodiment depicted therein, it will be seen that color grinder 10 is comprised of feed hopper 12, top yoke 14, radiator 16, power unit 18, hydraulic oil tank 20, and discharge conveyor 22.

Figure 2:
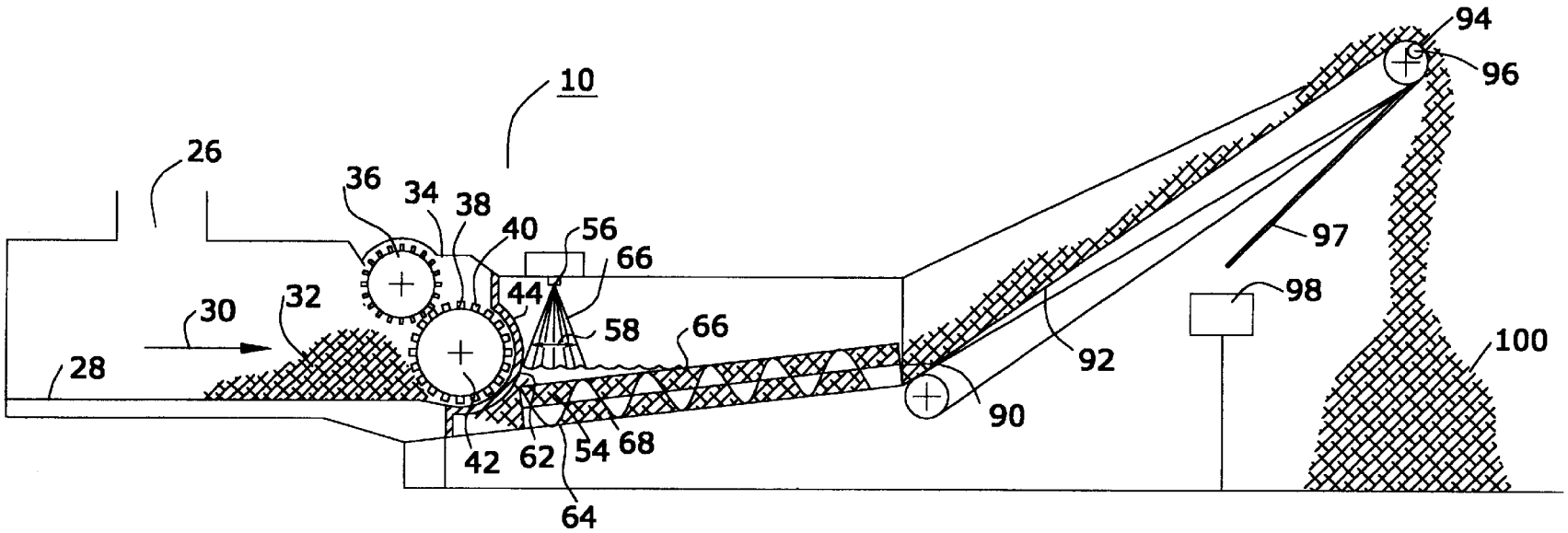
FIG. 2 is an exploded view of the apparatus of FIG. 1.

FIG. 2 is a schematic representation of one preferred color grinder 10. Referring to the embodiment depicted in FIG. 2, it will be seen that wood is fed into hopper 26 onto feed chain 28 which travels in the direction of arrow 30.

The wood used in the preferred process of this invention may be wood in any form and any state of dryness. Thus, e.g., the wood disclosed in U.S. Pat. No. 5,308,653 may be used in the process; the entire disclosure of this patent is hereby incorporated by reference into this specification. Thug, e.g., the wood may be green wood, dry wood with a moisture content of 30 percent of less, etc.

In one preferred embodiment, the wood used is substantially pure wood, that is, it contains at least about 90 weight percent of cellulosic material.

In one embodiment, the wood used is "curb waste," i.e., wood from tree trimmings, bushes, construction and demolition waste, wood pallets, etc.

Referring again to FIG. 2, the wood 32 is conveyed by feed chain 28 into contact with mill 34.

In one embodiment, e.g., the mill 34 may be one or more of the rotary grinding devices described in U.S. Pat. No. 5,794,866 (a rotatably mounted drum with a plurality of spaced cutter teeth attached to the exterior of the drum), U.S. Pat. Nos. 5,692,689, 5,609,113, 4,470,224, and the like.

In another embodiment, the mill assembly 34 may be a hammer mill assembly. Thus, e.g., one may use one or more of the hammer mills described in U.S. Pat. Nos. 4,354,487, 4,215,692, 4,035,217, and the like. The disclosure of each of these United States patents is hereby incorporated by reference into this specification.

Referring again to FIG. 2, and in the preferred embodiment depicted therein, mill 34 is comprised of a yoke 36 which feeds the wood into contact with hammer mill 38. As is known to those skilled in the art, the hammer mill 38 is comprised of a multiplicity of hammers 40 affixed to the exterior of drum 42. The hammers 40 may be either swing hammers or fixed hammers. In one preferred embodiment, fixed hammers are used.

Regardless of which comminuting device is used, the mill 34 preferably grinds wood 32 until substantially at least 80 weight percent of the wood ground by mill 34 has a maximum dimension less than 4.0 inches. In one embodiment, the ground wood produced by mill 34 has a particle size distribution such that at least about 80 percent of its particles are less than 3.0 inches in size. In yet another embodiment, at least about 80 weight percent of the particles produced by mill 34 are less than about 2.2 inches in size.

Referring again to FIG. 2, the ground wood produced by mill 34 is then contacted with a sieve 44 which separates all particles greater than 4.0 inches in size such that at least about 98 weight percent of the material percent of the material passing through sieve 44 is smaller than 4.0 inches and, more preferably, smaller than 3.0 inches. In the most preferred embodiment, at least about 98 percent of the sieved material is smaller than 2.0 inches.

Figure 3:
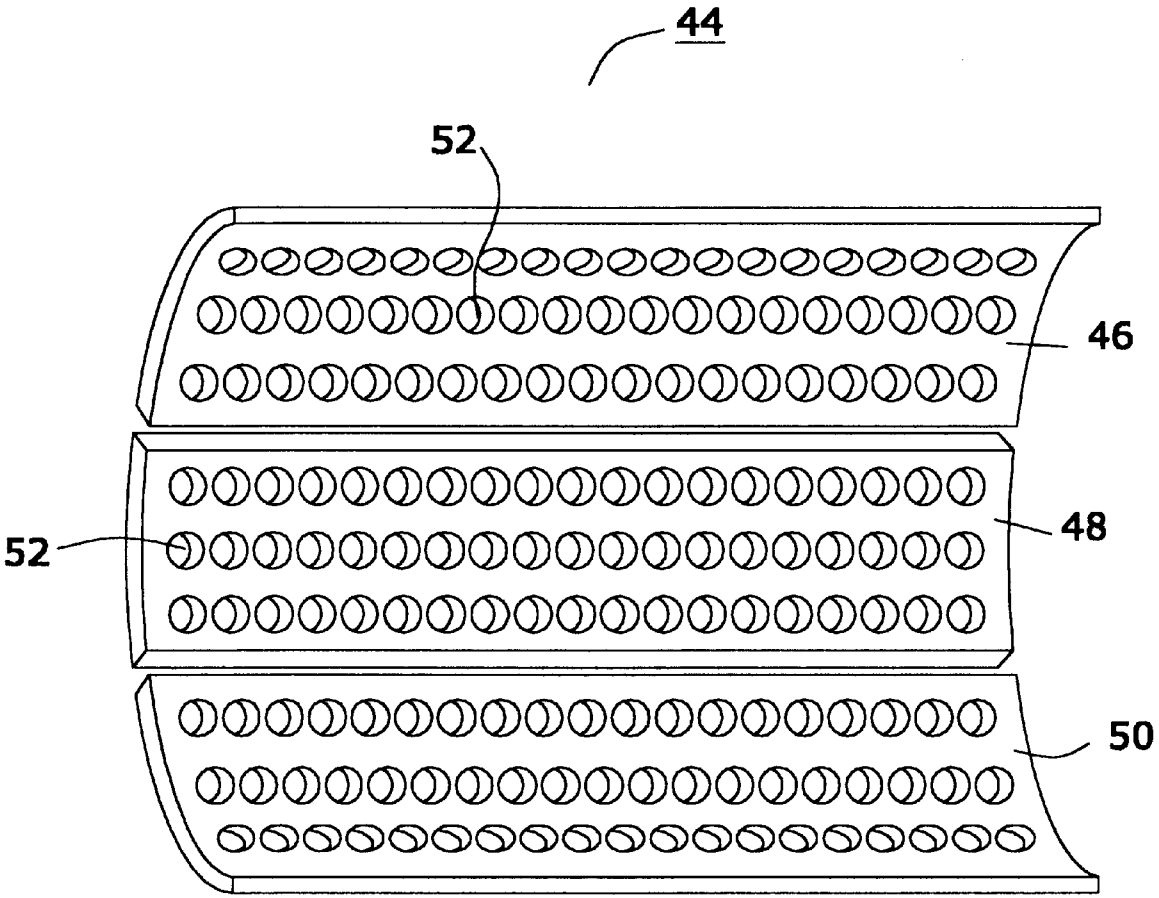
FIG. 3 a perspective view of a preferred screening device used in the apparatus of Figure.

FIG. 3 illustrates a preferred embodiment of sieve 44. In the preferred embodiment depicted, sieve 44 is comprised of section 46, section 48, and section 50; and the sieve openings in each of these sections are preferably circular in cross section. In another embodiment, not shown, the sieve openings have a substantially square shape.

Referring to FIG. 3, the sections 46, 48, and 50 are joined to each other by conventional means, such as by a track (not shown) into which these sections slide. In another embodiment, the sections 46, 48, and 50 are integrally joined to each other. In either event, the sieve assembly 44 presents no open area(s) for the passage of wood except for sieve openings 52.

Referring again to FIG. 2, the sieved material 54 passing through sieve 44 is sprayed with a colorant solution passing through a multiplicity of nozzles 56.

The colorant solution passing through the nozzles 56 produces a spray which extends over an area of at least about 4 feet. Thus, although not drawn to scale, width 58 of spray 60 generally extend form the exterior surface 62 of screen 44 past the base 64 of auger system 66. Residual spray 60 winds up into auger trays 68.

It will be seen thus, that the sieved material is first sprayed with colorant solution and then immersed within auger tray 68 which is filled with colorant solution.

Figure 4:
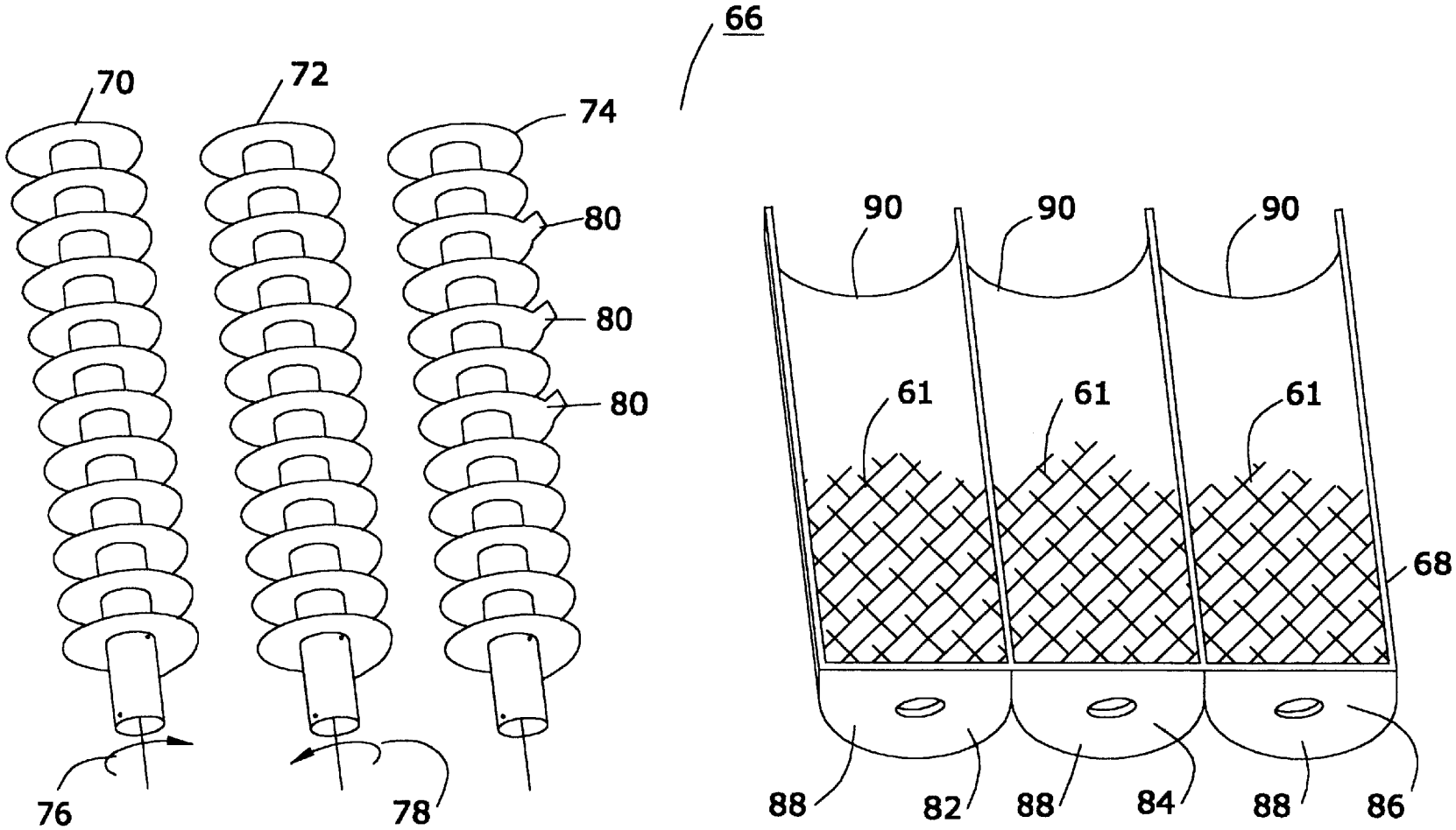
FIG. 4 is schematic view of one preferred augur assembly used in the apparatus of FIG. 1.

FIG. 4 is a schematic representation of auger system 66 which is comprised of a multiplicity of augers 70, 72, and 74. One may user one or more of the augers described in U.S. Pat. No. 5,308,653, the entire disclosure of which is hereby incorporated by reference into this specification.

Referring to FIG. 4, it is preferred to use at least two augers, such as augers 70 and 72, in process. When such auguers 70 and 72 are used, they preferably are rotated in opposite directions, such as, e.g., in the direction of arrows 76 and 78. The use of these counter-rotating augers 76 and 78 tends to promote better penetration of the colorant solution into the wood material.

It is preferred to use two, or a multiple of two, augers, each adjacent auger rotating in a direction opposite to that of the auger next to it. In one embodiment, illustrated in FIG. 4, each of the augers is comprised of paddles 80 connected to the periphery of one or more sections of one or more of the augers 70, 72, and/or 74. In general, paddles 80 have a substantially square shape and may be, e.g., approximately 4.0 inches square.

Referring again to FIG. 4, the augers 70, 72, and/or 74 are disposed within corresponding trays 82, 84, and 86, each of which is comprised of colorant solution 61. A sufficient amount of colorant solution 61 is disposed within each such tray 82, 84, and 86 that the sieved material 54 is immersed within the colorant solution. As will be apparent to those skilled in the art, as augers 70, 72 et seq. rotate, they move the sieved material 54 from the base 88 of the trays to the discharge end 90.

Referring again to FIG. 2, the material discharged at discharge end 90 then drops onto stacking conveyor 92 and preferably conveyed upwardly to a point 94 at which it preferably contacts magnetic separator 96, which removes metallic objects from the sieved material. The metallic objects then can be discharged through chute 97 to bin 98.

The sieved material is then discharged into a truck (not shown) or other suitable container (not shown) and allowed to drop into a heap of material 100.

The colorant material used in the process, which is also used to produce spray 60, preferably is an aqueous color-imparting solution containing at least one color-imparting agent therein. One suitable solution is described in U.S. Pat. No. 5,308,653, the entire disclosure of which is hereby incorporated by reference into this specification.

In one embodiment, the colorant may be an aqueous solution containing iron oxide pigment, carbon black pigment, or am mixture thereof.

In one embodiment, the colorant solution is sold as "AMERIMULCH" by the Amerimulch Company of 5549 Canal Road, Valley View, Ohio. In another embodiment, the colorant solution is sold as "MULCH MAGIC" by Becker Underwood Inc. of 801 Dayton Avenue, Ames, Iowa. Alternatively, one can purchase colorant solution from the T. H. Glennan Company.

By way of further illustration, one may use one or more of the colorants described in U.S. Pat. Nos. 4,932,156, 2,772,137 (light mahagony staining solution), U.S. Pat. No. 1,043,582 (brown wood coloring solution), U.S. Pat. No. 4,716,060 (colorant with a preservative component), U.S. Pat. No. 3,685,959 (natural wood colors), U.S. Pat. Nos. 2,623,027, 4,530,778, and the like. The disclosure of each of these United States patent applications is hereby incorporated by reference into this specification.

Regardless of the colorant solution used, it is preferred to contact the material passing through sieve 44 with at least about two pounds, by weight, of colorant per cubic yard of sieved material; substantially all of such two pounds is then incorporated into the sieved material. In one embodiment, at least four pounds of colorant, by dry weight, are incorporated into the sieved material. The preferred concentration of colorant in the finished product is from about 2.5 to about 4.0 pounds of colorant per cubic yard of dried finished product.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for producing a colored wood product, comprising the steps of grinding wood in a mill until a wood compact is formed with a particle size distribution such that at least about 80 percent of the particles of tie wood compact are smaller than about 4.0 inches, sieving said wood compact to produce a first sieved wood compact, spraying said first sieved wood compact with an aqueous solution of colorant to produce a first colored wood compact, immersing said first colored wood compact in a bath of aqueous solution of colorant while simultaneously moving said colored first colored wood compact with a multiplicity of counterrotating augers to thereby produce a second colored wood compact, and then removing said second colored wood compact from said bath.

2. The process as recited in claim 1, wherein a first counterrotating auger and a second counterrotating auger are used to move said first colored wood compact through said bath.

3. The process as recited in claim 2, wherein said mill is a rotating drum.

4. The process as recited in claim 2, wherein said mill is a hammer mill.

5. The process as recited in claim 4, wherein the hammers on said hammer mill are swing hammers.

6. The process as recited in claim 4, wherein the hammers on said hammer mill are fixed hammers.

7. The process as recited in claim 1, wherein said wood contains less than about 30 weight percent of moisture.

8. The process as recited in claim 7, wherein said wood contains at least about 90 weight percent of cellulosic material.

9. The process as recited in claim 1, wherein said mill is a rotatably mounted drum with a plurality of spaced cutter teeth attached to the exterior of said drum.

10. The process as recited in claim 1, further comprising the step of feeding said wood into contact with said mill by means of a yoke.

11. The process as recited in claim 1, comprising the step of sieving said compact so that at least about 98 weight percent of the material so sieved is smaller than about 2.0 inches.

12. The process as recited in claim 1, wherein said wood compact is sieved by passing it through a sieve containing circular mesh.

13. The process as recited in claim 1, wherein said first sieved wood compact is sprayed with a spray which has a maximum width of at least about 4.0 feet.

14. The process as recited in claim 1, wherein at least one of said augers is comprised of a paddle affixed to said auger.

15. The process as recited in claim 1, further comprising the step of removing metallic material from said second colored wood compact.

16. The process as recited in claim 1, wherein said colorant is a liquid.

17. The process as recited in claim 16, wherein said colorant is comprised of iron oxide pigment, carbon black pigment, or mixtures thereof.

18. The process as recited in claim 1, comprising the step of incorporating at least 2 pounds of said colorant into each cubic yard of said sieved wood material.

19. The process as recited in claim 1, comprising the step of incorporating from about 2.5 to about 4.0 pounds of said colorant into each cubic yard of said sieved wood material.

* * * * *